US012233302B2

(12) United States Patent
Gonzalez

(10) Patent No.: US 12,233,302 B2
(45) Date of Patent: Feb. 25, 2025

(54) MODULAR EXERCISE WEIGHT SYSTEM

(71) Applicant: Josue Gonzalez, San Juan, PR (US)

(72) Inventor: Josue Gonzalez, San Juan, PR (US)

( * ) Notice: Subject to any disclaimer, the term of this patent is extended or adjusted under 35 U.S.C. 154(b) by 187 days.

(21) Appl. No.: 18/136,783

(22) Filed: Apr. 19, 2023

(65) Prior Publication Data

US 2023/0347196 A1 Nov. 2, 2023

Related U.S. Application Data

(60) Provisional application No. 63/336,926, filed on Apr. 29, 2022.

(51) Int. Cl.
*A63B 21/06* (2006.01)
*A63B 21/00* (2006.01)

(52) U.S. Cl.
CPC ..... *A63B 21/0605* (2013.01); *A63B 21/4035* (2015.10); *A63B 21/0602* (2013.01); *A63B 21/0603* (2013.01); *A63B 21/0604* (2013.01)

(58) Field of Classification Search
CPC ..... A63B 21/00058; A63B 21/00061; A63B 21/00065; A63B 21/00069; A63B 21/0601; A63B 21/0602; A63B 21/0603; A63B 21/0604; A63B 21/0605; A63B 21/0607; A63B 21/072; A63B 21/075; A63B 21/4023; A63B 21/4035
See application file for complete search history.

(56) References Cited

U.S. PATENT DOCUMENTS 1,577,077 A * 3/1926 Huston ..... A63B 21/0605 84/467
2,616,467 A * 11/1952 Cicero ..... B65D 33/28 383/44
D262,690 S * 1/1982 Berry ..... D8/499
5,584,599 A * 12/1996 Knittel ..... E02B 3/127 52/561
6,099,441 A * 8/2000 Bonnet ..... A63B 21/0602 482/106
6,261,210 B1 * 7/2001 Lishejkov ..... A63B 69/222 482/90
6,491,431 B2 * 12/2002 Merten ..... E02B 3/127 405/114
7,828,703 B1 * 11/2010 Boesch ..... A63B 21/4049 482/93
8,276,351 B1 * 10/2012 Henkin ..... A63B 21/0603 53/469
9,914,002 B2 * 3/2018 Stroup ..... A63B 21/065
(Continued)

FOREIGN PATENT DOCUMENTS

AU 2008101262 A4 * 2/2009 ..... A63B 21/0602
AU 2016200802 B1 * 6/2016
(Continued)

*Primary Examiner* — Gary D Urbiel Goldner
(74) *Attorney, Agent, or Firm* — William Lovin & Associates LLC; William R. Lovin

(57) ABSTRACT

The device is a modular exercise weight system comprising at least one outer containing bag which can contain at least one particle filled weight bags. The user lifts the outer containing bag for exercise. Multiple outer containing bags may be affixed to a bar and the bar may be lifted for exercise. The outer containing bags may be affixed to an element of a machine and the element of the machine may be lifted or manipulated for exercise.

13 Claims, 2 Drawing Sheets

(56) References Cited

U.S. PATENT DOCUMENTS 10,149,997 B1 * 12/2018 Henniger ..... A63B 21/0603
10,252,097 B1 * 4/2019 Raines ..... E02B 3/127
10,293,201 B2 * 5/2019 Tomellini ..... A63B 21/075
10,343,009 B2 * 7/2019 Peyton ..... A63B 21/072
10,561,886 B2 * 2/2020 Bassoo ..... A63B 69/0093
10,864,982 B2 * 12/2020 Haas ..... B64B 1/70
10,981,030 B2 * 4/2021 Henniger ..... A63B 21/0603
11,318,345 B2 * 5/2022 Bassoo ..... A63B 21/0552
11,504,566 B2 * 11/2022 Fujii ..... A63B 21/0603
11,801,413 B2 * 10/2023 Henniger ..... A63B 21/0603
11,931,639 B2 * 3/2024 Coughlan ..... A63B 21/072
2006/0137950 A1 * 6/2006 Nassanian ..... A45C 7/0063 190/119
2007/0049469 A1 * 3/2007 Brown ..... A63B 21/0603 482/93
2010/0048363 A1 * 2/2010 Gilberti ..... A63B 21/0603 482/105
2012/0058863 A1 * 3/2012 Brizard ..... A63B 21/0603 482/93
2013/0343675 A1 * 12/2013 Gourchounian ..... E04H 15/64 141/10
2014/0309089 A1 * 10/2014 Buikema ..... A63B 21/0004 482/105
2015/0202486 A1 * 7/2015 Childs ..... A63B 21/0603 482/106
2016/0129292 A1 * 5/2016 Stroup ..... A63B 23/12 434/247
2017/0036056 A1 * 2/2017 Tomellini ..... A63B 21/072
2018/0085619 A1 * 3/2018 Chen ..... A63B 23/12
2018/0333603 A1 * 11/2018 Peyton ..... A63B 21/0605
2018/0353792 A1 * 12/2018 Henniger ..... A63B 21/0603
2019/0184252 A1 * 6/2019 Raines ..... A63B 41/085
2019/0269956 A1 * 9/2019 Henniger ..... A63B 21/0603
2019/0299046 A1 * 10/2019 Tomellini ..... A63B 21/4035
2020/0188721 A9 * 6/2020 Henniger ..... A63B 21/0603
2020/0215375 A1 * 7/2020 Fujii ..... A63B 21/072
2021/0113883 A1 * 4/2021 Bassoo ..... A63B 6/00
2021/0346777 A1 * 11/2021 Coughlan ..... A63B 21/0603
2022/0331640 A1 * 10/2022 Park ..... A63B 21/065

FOREIGN PATENT DOCUMENTS

DE 202014100859 U1 * 7/2014 ..... A45F 3/08
GB 2474062 A * 4/2011 ..... A63B 21/06
GB 2490595 A * 11/2012 ..... A63B 21/0602
JP H0722760 U * 4/1995 ..... A63B 21/075

* cited by examiner

MODULAR EXERCISE WEIGHT SYSTEM

CROSS-REFERENCE TO RELATED APPLICATIONS

This application makes reference to U.S. Prov. Pat. No. 63/336,926 filed 29 Apr. 2022 and incorporates that application, in its entity, by reference.

FIELD OF THE INVENTION

The present invention relates to a modular exercise weight system and the sub-devices (particle filled weight bags) that comprise it.

BACKGROUND OF THE INVENTION

There are numerous types of weight training systems. From free weights to cable-tethered weight training systems, hundreds of systems are available. Many of these systems are modular, i.e. the weight to be lifted or manipulated may be adjusted higher or lower. These weight training systems are constructed using various materials: steel, iron, cement, sand, plastic, etc.

None of these inventions are constructed of cloth or plastic, however.

What is needed is a weight training system constructed using cloth or plastic bags and containers, wherein the cloth or plastic bags and containers are filled with sand, cement, stone, water, or other various other substances, including but not limited to metal powder, metal particles, or metal bars or pellets.

The weight training system would be modular, comprising a multiplicity of different sized cloth or plastic bags and containers.

The weight training system would be comprised of cloth or plastic bags and containers filled with a variety of substances, including sand, cement, stone, water, etc.

The weight training system would be comprised of a multiplicity of filled cloth or plastic bags or other containers of different sizes or volumes.

The weight training system would be comprised of a containing cloth or plastic bag that organizes and collects the other cloth or plastic bags or that contains sand, cement, water, stone, etc.

The weight training system would be comprised of a containing cloth or plastic bag that is further comprised of flaps at the top that may be closed securing the cloth or plastic bags containing sand, cement, water, stone, etc. within.

Finally, the weight training system would be comprised of a containing cloth or plastic bag that is further comprised of a multiplicity of straps affixed to opposite sides of the top of the containing cloth or plastic bag: 1) Below the level of the flaps on one end; and, 2) An inflexible rigid handle on the other end.

SUMMARY OF THE INVENTION

The present invention is comprised of a multiplicity of cloth or plastic bags of different sizes and volumes, each filled with sand, cement, water, stone, etc. Other materials may be readily used as filling materials, including, but not limited to, metallic pieces or pellets, gel-type substances, plastic pieces or pellets, or any combination thereof.

This multiplicity of cloth or plastic bags of different sizes and volumes may be arranged to form a rectangular weight prism. The multiplicity of cloth or plastic bags of different sizes and volumes may be affixed together by means of strips of adhesive fastener such as Velcro®.

This rectangular weight prism fits inside a containing cloth or plastic bag with flaps that extend above the top of the rectangular weight prism such that the flaps may be folded down and closed over the rectangular weight prism closing it inside the containing cloth or plastic bag. The flaps may be closed and affixed to one another by means of strips of adhesive fastener such as Velcro®.

A multiplicity of straps or cords are affixed at one end to the opposite sides of the containing cloth or plastic bag below the level of the flaps affixed to the top aspects of each side of the containing cloth or plastic bag. The other end of the straps or cords is affixed to an inflexible rigid handle. The inflexible rigid handle may be straight or curved along its linear axis. The inflexible rigid handle may be sewn or reinforced with wood, plastic, or metal. The straps or cords may be affixed to the containing cloth or plastic bag by means of stitching, weaving, gluing, or sonic welding.

The invention is used in the following manner: First, the user selects a multiplicity of filled cloth or plastic bags or other containers of different sizes or volumes that added together constitutes the weight that the user wishes to lift as part of the exercise routine. Next, the user affixes the multiplicity of filled cloth or plastic bags or other containers together to form a roughly rectangular weight prism. The multiplicity of filled cloth or plastic bags or other containers may be affixed together by means of strips of adhesive fastener such as Velcro®. Next, the user places the roughly rectangular weight prism inside a containing cloth or plastic bag or other container. Next, the user folds flaps on opposite sides of the enclosing cloth or plastic bag or other container down to cover the roughly rectangular weight prism. The flaps may be secured in the closed position by means of strips of adhesive fastener such as Velcro® affixed to the opposite sides of the flaps on the opposing sides of the enclosing cloth bag or other container. Next, the user exercises by lifting the enclosing cloth or other container containing the filled cloth or plastic bags or other containers representing the total weight desired.

DETAILED DESCRIPTION OF THE EMBODIMENTS

Figure 1:
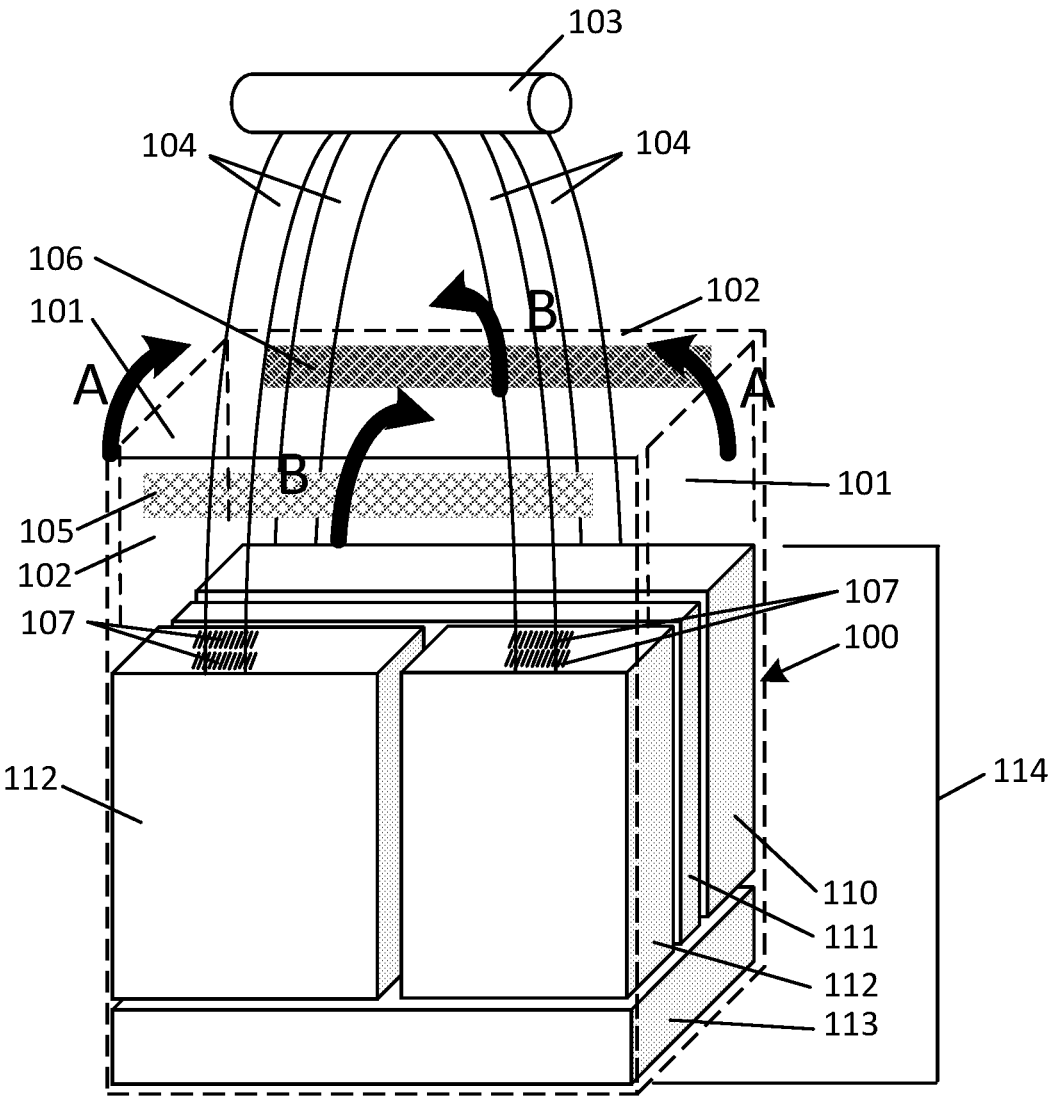
FIG. 1 comprises a perspective view of a containing cloth or plastic bag or other container containing a roughly rectangular weight prism comprising a multiplicity of filled cloth or plastic bags or other containers containing sand, cement, water, stone, etc.

Turning now to FIG. 1, a first variant of a modular exercise weight system is disclosed. The present invention is comprised of a multiplicity of cloth or plastic bags of different sizes and volumes (110, 111, 112, and 113), each filled with sand, cement, water, or stone. Other materials may be readily used as filling materials, including, but not limited to, metallic pieces or pellets, gel-type substances, plastic pieces or pellets, or any combination thereof.

This multiplicity of cloth or plastic bags of different sizes and volumes (110, 111, 112, and 113) may be arranged to form a rectangular weight prism 114. The multiplicity of cloth or plastic bags of different sizes and volumes (110, 111, 112, and 113) may be affixed together by means of strips of adhesive fastener such as Velcro®.

This rectangular weight prism 114 fits inside a containing cloth or plastic bag 100 with flaps 101 and 102 that extend above the top of the rectangular weight prism 114 such that the flaps 101 and 102 may be folded down and closed over the rectangular weight prism 114 closing it inside the containing cloth or plastic bag 100. Flaps 101 and 102 may be closed over the rectangular weight prism 114 in pairs by folding flaps 101 in direction A and then flaps 102 in direction B. The flaps 101 and 102 may be affixed to one another by means of strips of adhesive fastener 105 and 106 such as Velcro®.

A multiplicity of straps or cords 104 are affixed at one end to the opposite sides of the containing cloth or plastic bag 100 below the level of the flaps 101 and 102 affixed to the top aspects of each side of the containing cloth or plastic bag 100. The other end of the straps or cords 104 is affixed to an inflexible rigid handle 103. The inflexible rigid handle 103 may be straight or curved along its linear axis. The inflexible rigid handle 103 may be sewn in fabric construction or reinforced with wood, plastic, or metal sewn in the fabric. Inflexible rigid handle 103 may be tubular or hollow. The straps or cords 104 may be affixed to the containing cloth or plastic bag by means of stitching 107, weaving, gluing, or sonic welding, The invention is used in the following manner: First, the user selects a multiplicity of filled cloth or plastic bags of different sizes and volumes (110, 111, 112, 113) or other containers of different sizes or volumes that added together constitutes the weight that user wishes to lift as part of the exercise routine. Next, the user affixes the multiplicity of filled cloth or plastic bags (110, 111, 112, 113) or other containers together to form a roughly rectangular weight prism 114. The multiplicity of filled cloth or plastic bags of different sizes and volumes (110, 111, 112, 113) or other containers may be affixed together by means of strips of adhesive fastener such as Velcro®. Next, the user places the roughly rectangular weight prism 114 inside a containing cloth or plastic bag 100 or other container. Next, the user folds flaps 101 and 102 on opposite sides of the enclosing cloth or plastic bag 100 or other container down to cover the roughly rectangular weight prism 114. Flaps 101 and 102 may be secured in the closed position by means of strips of adhesive fastener such as Velcro® affixed to the opposite sides of the flaps 101 and 102 on the opposing sides of the enclosing cloth bag or other container 100. Next, the user exercises by lifting the enclosing cloth or other container 100 containing the filled cloth or plastic bags of different sizes and volumes (110, 111, 112, 113) or other containers representing the total weight desired.

Figure 2:
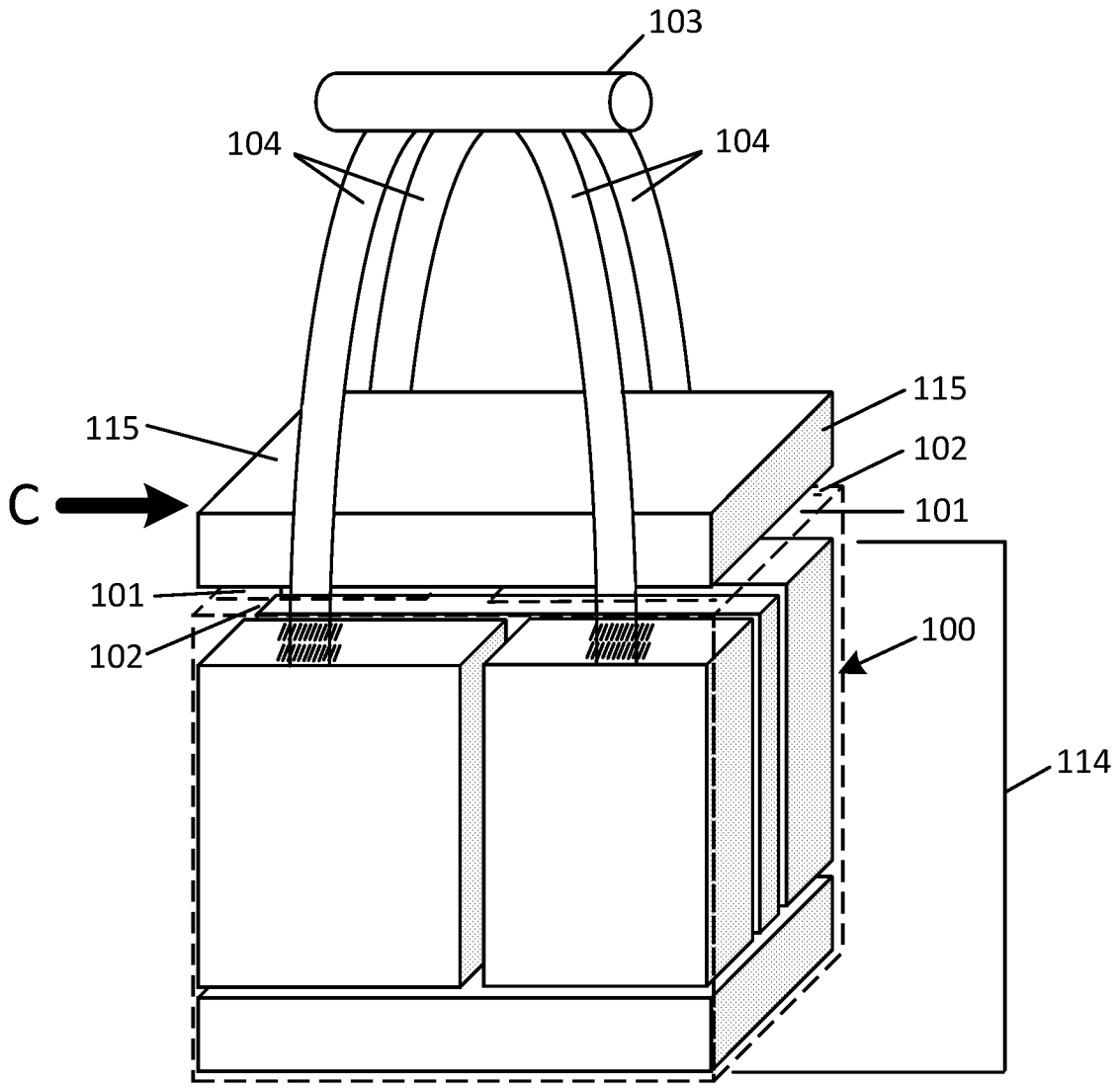
FIG. 2 comprises a perspective view of a containing cloth or plastic bag or other container containing a roughly rectangular weight prism comprising a multiplicity of filled cloth or plastic bags or other containers containing sand, cement, water, stone, etc. wherein the enclosing flaps are folded down, enclosing the multiplicity of filled cloth or plastic bags or other containers containing sand, cement, water, stone, etc. and an additional filled cloth or plastic bags or other container containing sand, cement, water, stone, etc. is inserted between the straps of the containing cloth or plastic bag.

Turning now to FIG. 2, a second variant of a modular exercise weight system is disclosed. The present invention 100 is comprised of a multiplicity of cloth or plastic bags of different sizes and volumes, each filled with sand, cement, water, or stone. Other materials may be readily used as filling materials, including, but not limited to, metallic pieces or pellets, gel-type substances, plastic pieces or pellets, or any combination thereof.

This multiplicity of cloth or plastic bags of different sizes and volumes may be arranged to form a rectangular weight prism 114. The multiplicity of cloth or plastic bags of different sizes and volumes may be affixed together by means of strips of adhesive fastener such as Velcro®.

This rectangular weight prism 114 fits inside a containing cloth or plastic bag 100 with flaps 101 and 102 that extend above the top of the rectangular weight prism 114 such that the flaps 101 and 102 may be folded down and closed over the rectangular weight prism 114 closing it inside the containing cloth or plastic bag 100.

A multiplicity of straps or cords 104 are affixed at one end to the opposite sides of the containing cloth or plastic bag 100 below the level of the flaps 101 and 102 affixed to the top aspects of each side of the containing cloth or plastic bag 100. The other end of the straps or cords 104 is affixed to an inflexible rigid handle 103. The inflexible rigid handle 103 may be straight or curved along its linear axis. The inflexible rigid handle 103 may be sewn in fabric construction or reinforced with wood, plastic, or metal sewn in the fabric. Inflexible rigid handle 103 may be tubular or hollow. The straps or cords 104 may be affixed to the containing cloth or plastic bag by means of stitching, weaving, gluing, or sonic welding, An additional cloth or plastic bag 115 of different size and volume, filled with sand, cement, water, or stone may be slid in direction C on top of the containing cloth or plastic bag 100 inside of the multiplicity of straps or cords 104. Those having skill in the art will recognize that the additional cloth or plastic bag 115 may be placed on top of the containing cloth or plastic bag 100 inside of the multiplicity of straps or cords 104 by other means, including sliding it into position from the opposite direction. Those having skill in the art will recognize that a multiplicity of additional cloth or plastic bags 115 may be placed on top of one another on top of the containing cloth or plastic bag 100 inside of the multiplicity of straps or cords 104. By this means, additional cloth or plastic bags 115 of different sizes and volumes, each filled with sand, cement, water, stone, etc. may added to the weight of rectangular weight prism 114.

Two containing cloth or plastic bags 100 containing rectangular weight prisms 114 may be lifted or manipulated, one in each hand, by inflexible rigid handle 103 and used as dumbbells in an exercise routine. Also, the inflexible rigid handles 103 affixed to two or more containing cloth or plastic bags 100 containing rectangular weight prisms 114 may be placed over a metal bar and the entire assembly may be used as a barbell in an exercise routine. Similarly, the inflexible rigid handles 103 affixed to at least one containing cloth or plastic bags 100 containing rectangular weight prisms 114 may be affixed as the element of a machine and the element of the machine may be used in an exercise machine.

While the present invention has been described in what are thought to be the most useful variant, those skilled in the art will readily recognize that equivalent arrangements are easily constructed. All such variants that seek to alter: 1) The location and number of filled cloth or plastic bags or other containers; 2) The type of filling material placed inside the filled cloth or plastic bags or other containers; 3) The method of assembling the filled cloth or plastic bags or other containers together; and, 4) The capacity and general shape of the device are included in the spirit and scope of the present invention.

What is claimed is:

1. A modular exercise weight system formed as a substantially rectangular weight prism, the modular exercise weight system, comprising:

a) a containing cloth or plastic bag comprising a bag portion and affixed flaps wherein the affixed flaps are located above the bag portion and are configured to be folded over to cover the bag portion;

b) at least one filled cloth or plastic bag that may be placed inside of the bag portion which when there is more than one filled cloth or plastic bag the multiplicity of filled cloth or plastic bags are held together with strips of adhesive fasteners;

c) a series of straps or cords proceeding from an outside of the bag portion up and over the affixed flaps above the bag portion wherein the series of straps or cords are affixed to a handle on a terminal end of the series of straps or cords;

d) wherein at least one additional filled cloth or plastic bag is configured to be placed between the series of straps or cords above the affixed flaps above the bag portion and below the handle.

2. The modular exercise weight system of claim 1 wherein the at least one filled cloth or plastic bag are filled with sand.

3. The modular exercise weight system of claim 1 wherein the at least one filled cloth or plastic bag are filled with cement.

4. The modular exercise weight system of claim 1 wherein the at least one filled cloth or plastic bag are filled with water.

5. The modular exercise weight system of claim 1 wherein the at least one filled cloth or plastic bag are filled with stone.

6. The modular exercise weight system of claim 1 wherein the handle is inflexible.

7. The modular exercise weight system of claim 1 wherein the handle is wood reinforced.

8. The modular exercise weight system of claim 1 wherein the handle is plastic reinforced.

9. The modular exercise weight system of claim 1 wherein the handle is tubular.

10. The modular exercise weight system of claim 1 wherein the containing cloth or plastic bag is affixed to a bar and the bar is lifted or manipulated for exercise.

11. The modular exercise weight system of claim 1 wherein the containing cloth or plastic bag is affixed to an element of a machine and the element of the machine is lifted or manipulated for exercise.

12. The modular exercise weight system of claim 1 comprising a multiplicity of containing cloth or plastic bags each of which contains at least one filled cloth or plastic bag wherein the multiplicity of containing cloth or plastic bags are affixed to a bar and the bar is lifted or manipulated for exercise.

13. The modular exercise weight system of claim 1 comprising a multiplicity of containing cloth or plastic bags each of which contains at least one filled cloth or plastic bag wherein the multiplicity of containing cloth or plastic bags are affixed to an element of a machine and the element of the machine is lifted or manipulated for exercise.

* * * * *